US005377460A

United States Patent [19]

Hicks

[11] Patent Number: 5,377,460

[45] Date of Patent: Jan. 3, 1995

[54] DOME BUILDING

[76] Inventor: Carl Hicks, 4 Ridgewood Avenue, Moncton, New Brunswick, E1A 3N9, Canada

[21] Appl. No.: 73,084

[22] Filed: Jun. 8, 1993

[51] Int. Cl.[6] ..... E04B 1/32

[52] U.S. Cl. ..... 52/81.1; 52/80.1

[58] Field of Search ..... 52/81.1, 81.2, 81.3, 52/81.4, 81.5, 80.1, 82

[56] References Cited

U.S. PATENT DOCUMENTS 3,820,292 6/1974 Fitzpatrick ..... 52/81.5
3,925,944 12/1975 O'Connell, Jr. et al. ..... 52/81.1
4,784,172 11/1987 Yacoboni ..... 52/81.1 X

*Primary Examiner*—Carl D. Friedman
*Assistant Examiner*—Creighton Smith
*Attorney, Agent, or Firm*—McFadden, Fincham

[57] ABSTRACT

Building structures are disclosed which employ isosceles triangles, isosceles trapezoids and rectangles as the panel shape of which the structure is made. The structure is arranged in horizontal levels with at least one upper level having a common panel type with the remaining levels having alternating patterns of rectangles and trapezoids or rectangles and triangles. The structures employ a substantial number of rectangular panels which contributes to less waste of construction material, while at the same time facilitating easier assembly.

25 Claims, 5 Drawing Sheets

DOME BUILDING

FIELD OF THE INVENTION

The present invention relates to a building structure and more particularly the invention relates to an improved dome building.

BACKGROUND OF THE INVENTION

Generally speaking, dome type buildings have always been popular due to the many advantages such structures afford. A few examples of such advantages include:

- a building may be constructed using a minimum of material;
- a stable, free standing structure without the need for internal support;
- high energy efficiency due to natural air circulation, less surface area for space enclosed and less air filtration due to the curved surface.

One of the more popular designs for dome buildings employs a plurality of triangular units. While such a unit generally provides for an efficient use of space, there is a substantial waste of material as the triangular members are cut from rectangular sheets. Further, there are limitations to the size of a building that can be made employing triangular units. The greater the size requirement, the greater the area of triangle required, and the number of differently sized triangles required.

The prior art provides a host of different dome buildings most of which employ a variety of seam-free panels. Typical of the known arrangements is illustrated in Canadian Patent No. 896,836. This reference teaches the use of one type panel and more specifically, one geometric shape, i.e. polygons. The patentee does not disclose the use of a variety of geometric shaped which may be positioned in an alternating pattern for maximum size with minimum material.

Further, U.S. Pat. No. 4,306,392, evinces a dome structure composed of isosceles trapezoids, hexagons, triangles and various other polygonal members. The reference teaches an alternating pattern of shapes, however the dome requires several different types and sizes of panels which may pose difficulty at the manufacturing stage.

U.S. Pat. No. 3,925,940, relates to a geodesic type building in which a substantial member of the panels are triangular. This type of structure, although useful, would result in a significant amount of wasted material when the triangular panels are cut from rectangular sheathing.

Similarly, U.S. Pat. No. 4,263,758, discloses a geodesic structure composed of many triangular members.

Further prior art related to dome type structures includes U.S. Pat. Nos. 4,287,690, 4,665,664 and 4,723,382.

SUMMARY OF THE INVENTION

One object of the present invention is to provide an improved dome building.

A further object of the present invention is to provide a dome building which significantly reduces the amount of material wasted during construction.

Another object of the present invention is to provide a dome building providing panels which are more easily engageable to construct the dome.

One broad object of the invention is to provide a building structure comprising: a plurality of first panels, of second panels and of third panels, the first panels comprising rectangular panels, the second panels and the third panels having a different geometry from one another and from the rectangular panels; at least one upper horizontal level of a common panel geometry other than the rectangular panels; at least two further horizontal levels having an alternating arrangement of two panel types of the first panels, second panels and third panels, the second panels and the third panels having at least three sides, the panels including connecting means for connection with an adjacent panel.

The structure advantageously only uses three geometric shapes for the panels, e.g. isosceles triangles, isosceles trapezoids and rectangles. Typically, the buildings employ about 50% or more rectangular panels; this provision significantly reduces the waste factor for sheathing which is sold in rectangular sheets.

Additional advantages concomitant with the choice of panel geometry and arrangements thereof according to the present invention include the fact that the design is adaptable to a specific need, the designs are simpler to fabricate and erect and easy to shingle.

Conveniently, the structure may be erected on rectangular vertically oriented panels. This avoids the loss of space at the base. In an alternative arrangement, the panels may be sloped inwardly at the base as required.

The panels may comprise any suitable material, e.g. wood, plastic or metal, etc., the selection being dependent on intended application.

Clearly, substantial size variation is possible with the structures. Use of the structures according to the present invention may be found for a cottage, summer house, gazebo, storage building, covered hangar for aircraft storage, etc.

The dome size can easily be enlarged to suit various applications simply by increasing the quantity of each panel type without altering shape. This is in contrast to domes essentially composed of triangular panels since such structures must either increase the size of the triangles and/or the number of different triangles. This results in cost ineffectiveness.

A further object of one embodiment of the present invention is to provide a dome building structure comprising: a plurality of first panels, of second panels and of third panels, the first panels comprising rectangular panels, the second panels and the third panels having a different geometry from one another and from the rectangular panels; at least one upper horizontal level having a common panel geometry other than the rectangular panels and connected together in a predetermined quantity; at least two further horizontal levels having an alternating arrangement of two panel types of the first panels, second panels and third panels, the two panel types of each of the further levels each being in the predetermined quantity, each of the panels having means for connection with an adjacent panel.

In an alternate embodiment, the structure, according to the present invention, may be open if use in intended for example, as a sports arena. If it is desired to have a covered structure, the same may be done with panels or a domed structure.

A still further object of the present invention is to provide a method of assembling a dome structure, comprising the steps of: providing a plurality of panels of a first type, of a second type and of a third type, the panels having at least three sides, the first type comprising rectangular panels, the second type and the third type having a different geometry from one another and from the rectangular panels; connecting a plurality of panels having a common geometry together to form at least one horizontal level, the panels selected from the second type and the third type; and connecting a plurality of panels together in an alternating relationship to form at least two further horizontal levels, the panels selected from the first type, second type and the third type, each the further level having two panel types.

Yet another object of the present invention is to provide a building structure comprising a plurality of first panels, of second panels and of third panels, each of the panels having a different geometry from one another and having at least three sides, the panels being arranged in a plurality of superposed horizontal levels, each horizontal level comprising an alternating arrangement of two panel types of the first panels, second panels and third panels, the panels including connecting means for connection with an adjacent panel.

Further, the domed structures may be employed as a roof for an existing structure.

Having thus generally described this invention, reference will now be made to the accompanying drawings, illustrating preferred embodiments.

BRIEF DESCRIPTION OF THE DRAWINGS

Similar numerals are representative of similar elements.

DETAILED DESCRIPTION OF THE PREFERRED EMBODIMENTS

Figure 1:
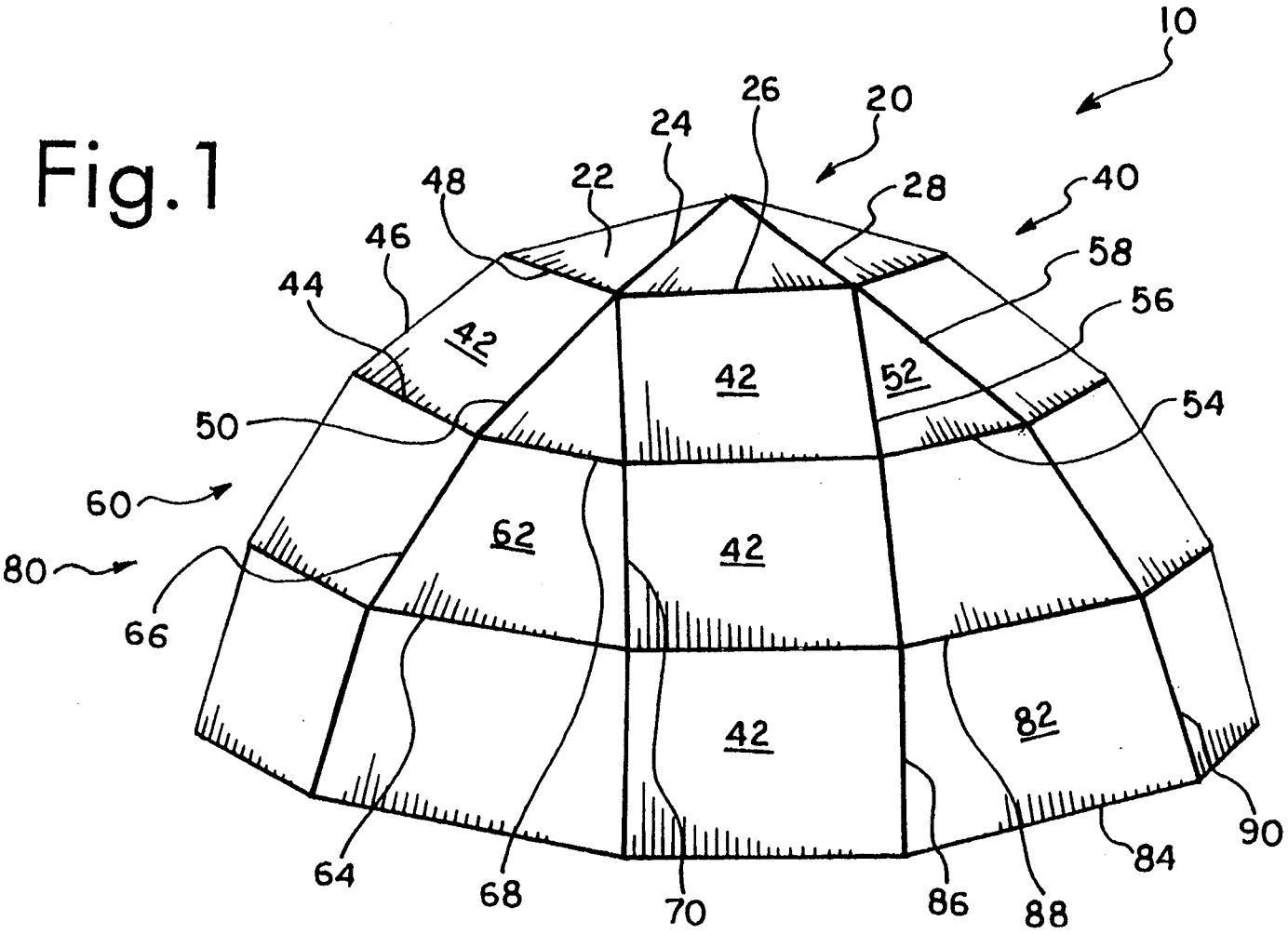
FIG. 1 is a perspective view of one embodiment according to the present invention.

FIG. 1 illustrates a perspective view of one embodiment of the present invention, the structure being generally denoted by numeral 10.

The building structure includes a plurality of horizontal levels 20, 40, 60 and 80.

Level 20 comprises an upper level, and in this embodiment comprises a plurality of juxtaposed and connected isosceles triangular panels. The triangular panels 22 have sides 24, 26 and 28, the sides being configured for connection with an adjacent panel 22. The fastening arrangement of the panels will be discussed hereinafter. In this embodiment, the frequency of isosceles triangular panels 22 in level 20 is six, i.e. six triangular panels 22 are included at the upper level of the structure 10.

Level 40 is a second horizontal upper level which comprises a plurality of further panel types joined together in juxtaposition. In this level, rectangular panels 42 having sides 44, 46, 48 and 50 alternate with and are connected to isosceles triangular panels 52. The isosceles triangular panels 52 have sides 54, 56 and 58, sides 54 and 58 each is connected to a side 46 and 50 of a laterally adjacent rectangular panel 42. The area of triangular panels 52 is less than panels 22 in the level 20. The frequency, i.e. the quantity, of panels 42 in level 40 exactly corresponds to that of the panels 22 in level 20, the latter establishing the frequency for the entire structure 10. A similar frequency is ascribed to panels 52.

Level 60 includes the third type of panel in the structure according to the present invention, i.e. trapezoidal panels 62. The panels 62 are isosceles trapezoids with sides 64, 66, 68 and 70. Panels 62 alternate with and are connected to rectangular panels 42. Sides 66 and 70 of panel 62 connect with sides 48 and 46, respectively. Panels 62 and 42 subscribe to a similar frequency to that in level 40.

Level 80 includes rectangular panels 42 and isosceles trapezoidal panels 82 having sides 84, 86, 88 and 90. Panels 82 have a greater area than panels 62. Panels 82 alternate with and are connected to panels 42 and more particularly, sides 86 and 90 are connected to sides 48 and 46 of laterally adjacent panels 42.

The frequency of panels 82 and 42 each is the same as that indicated for panels 22 in level 20.

The rectangular panels 42 maintain a constant width from level 80 to level 20.

Figure 2:
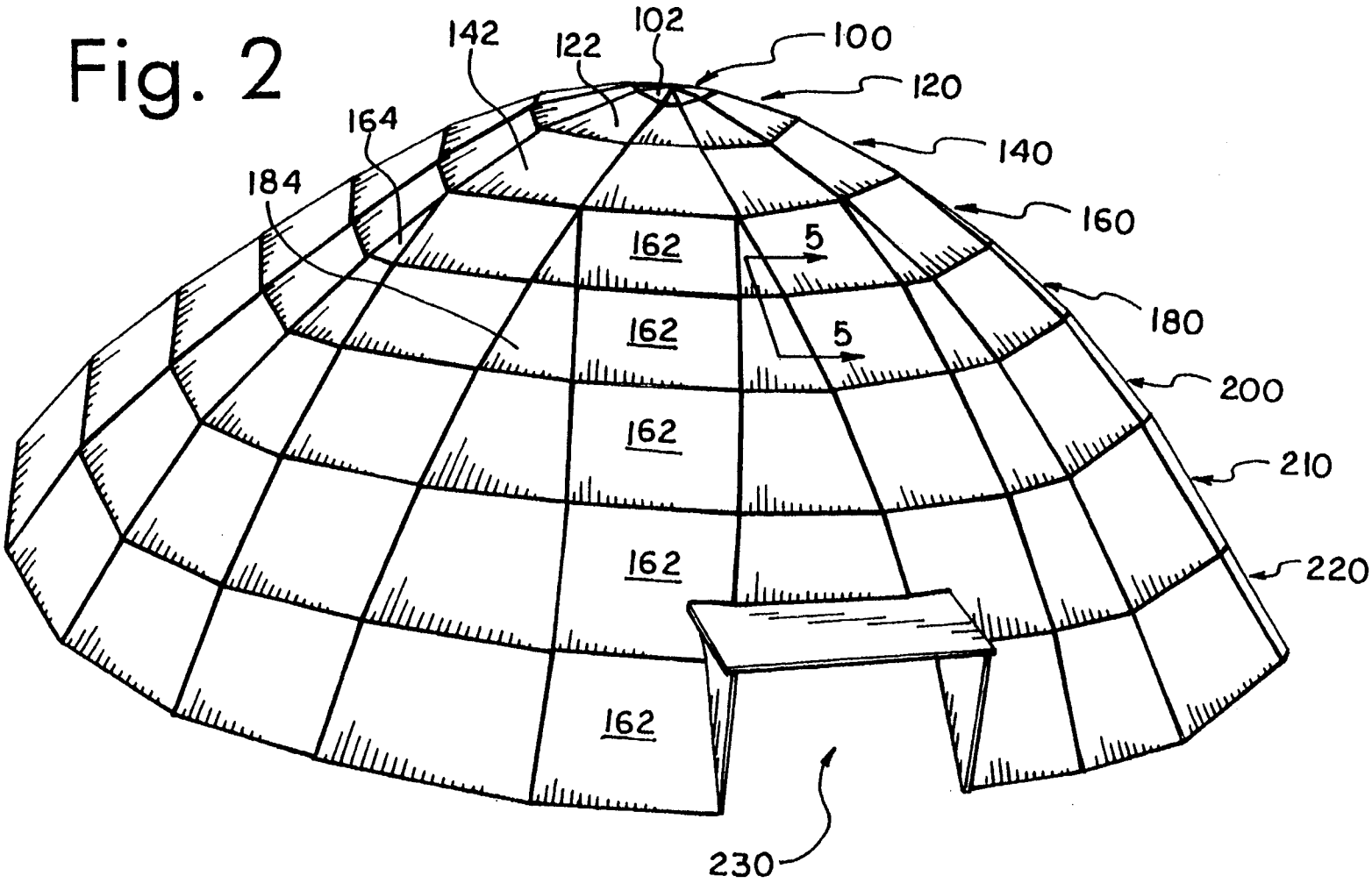
FIG. 2 is a perspective view of a second embodiment of the invention.

FIG. 2 illustrates a second embodiment of the present invention. In this embodiment, the number of levels is increased with the horizontal top portion of the structure including a plurality of levels each having a single type of panel. Levels 100, 120 and 140 each include isosceles triangular panels 102, isosceles trapezoidal panels 122, and further isosceles trapezoids 142, respectively having a larger area then trapezoidal panels 122.

Level 160 provides an alternating sequence of rectangles 162 and isosceles triangles 164. The panels are connected to one another and the panels in level 140 as well as the lower level in a similar manner to that described herein previously.

Level 180 provides an alternating sequence of rectangular panels 162 and isosceles trapezoidal panels 184.

In this embodiment, the frequency of panels 102 in level 100 is 11. This frequency is observed for all panels in the remaining levels. Additionally, as will be clear from FIG. 2, the area of the trapezoidal panels increases from level 180 through level 220.

The embodiment illustrated in FIG. 2 provides a door 230.

Figure 3:
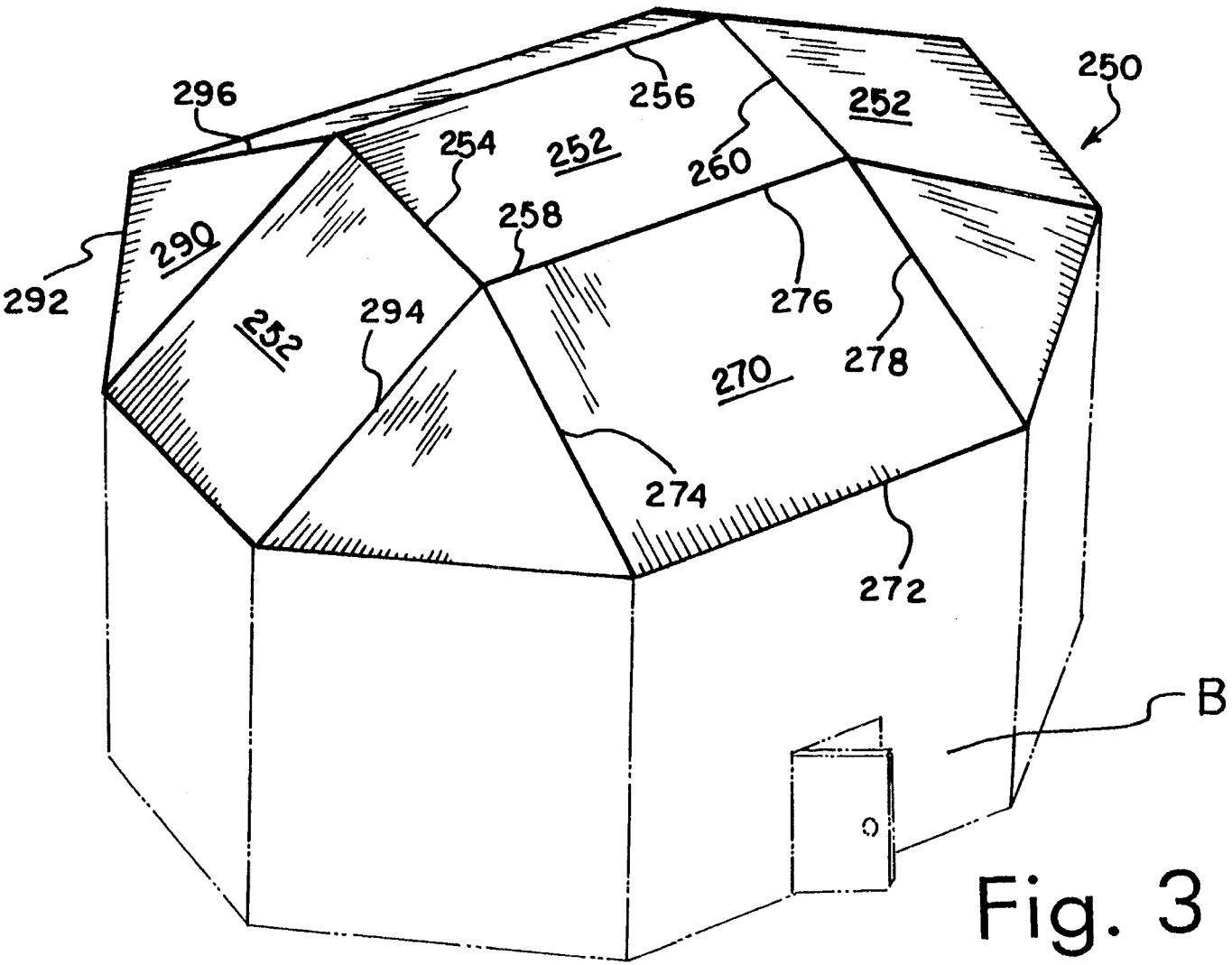
FIG. 3 is a perspective view of a third embodiment of the present invention.

FIG. 3 shows a further embodiment of the invention in which the building is elliptical. Numeral 250 denotes an elliptical structure suitable for use as a roof on a building, B. The roof 250 includes a series of rectangular panels 252 each having sides 254, 256, 258 and 260. Each of rectangular panels 252 has the same width.

Rectangular panels 270 are included in roof 250 having sides 272, 274, 276 and 278. Panels 270 are greater in width than panels 252. In addition, the larger panels 270 are preferably positioned in opposition to one another within the same level, only one level being illustrated in the case of the roof 250.

Isosceles triangular panels 290 having sides 292, 294 and 296 complete the roof 250.

It will be clear that respective sides of the panels will be connected with adjacent panels to form an integral roof 250.

Further rectangular panels (not shown) may be connected to sides 254, 272 and 292 and extend generally perpendicularly therefrom to provide an enclosed building, e.g. a cottage.

Windows, doors, etc. may be included when the structure is intended for this application. The embodiment illustrated is achieved by varying the structures illustrated in FIGS. 1 and 2 in terms of the width of the rectangular panels 270. The width of any number of rectangular panels in the structure may be changed provided it is an even number of the panels within a given level and that panels changed having similar widths are in opposed relation with one another.

Figure 4:
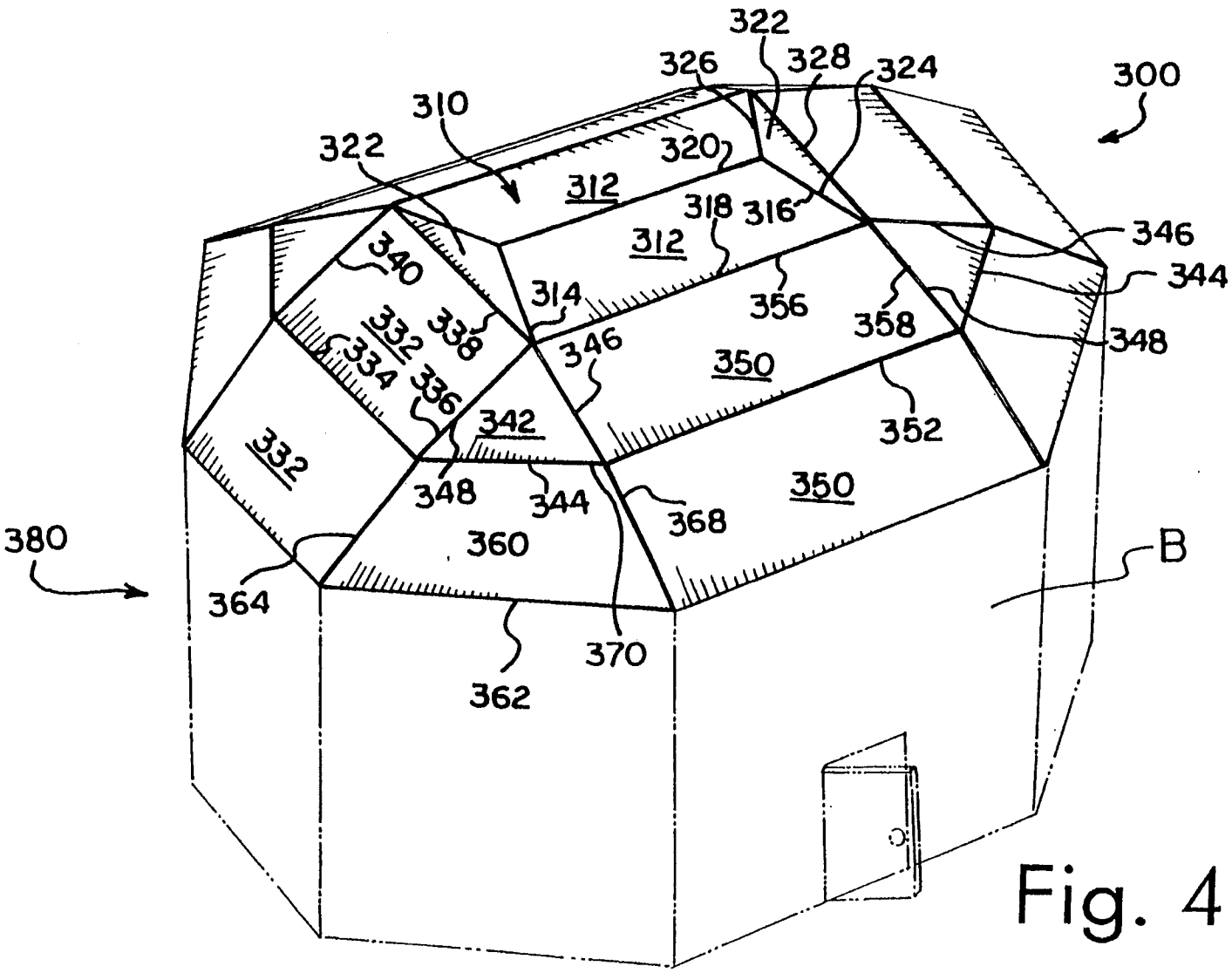
FIG. 4 is a section view of a fourth embodiment of the present invention.

FIG. 4 illustrates a further roof structure 300, which is a variation of that illustrated in FIG. 3. In this embodiment, a plurality of superposed levels 310, 330 and 380 are provided in the examples. Level 310, the upper level, includes trapezoidal panels 312 having opposed sides 314, 316 and 318, 320 and triangular panels 322 having sides 324, 326 and 328. The trapezoidal panels 312 and 322 are inclined to form a peak on the roof 300. Common sides 320 of panels 312 are joined together and sides 314 and 316 are connected to sides 324 and 326, respectively of triangular panels 322, the latter having sides 334, 336, 338 and 340, triangular panels 342 having sides 344, 346 and 348, and second rectangular panels 350 having sides 352, 354, 356 and 358.

Each first rectangular panel 332 connects at sides 336 and 340, a triangular panel 342 at side 348 and 346, respectively. The adjacent side of each of the triangular panels 342 is connected to a rectangular panel 350. The sequence of first rectangular panels 332 and triangular panels 342 is repeated as illustrated in the Figure.

Level 380 includes identical panels 332 and 350 from level 330 and further includes trapezoidal panel 360 having sides 362, 364, 366 and 368. Panels 332 each are connected in a similar manner to that described above on both sides to a trapezoidal panel 360 and each of these is connected to a rectangular panel 350. Similar to the single level embodiment illustrated in FIG. 3, the rectangular panels 332 and 350 differ in width with common panel widths being even in number and in opposed relation with one another in a respective level.

Figure 5:
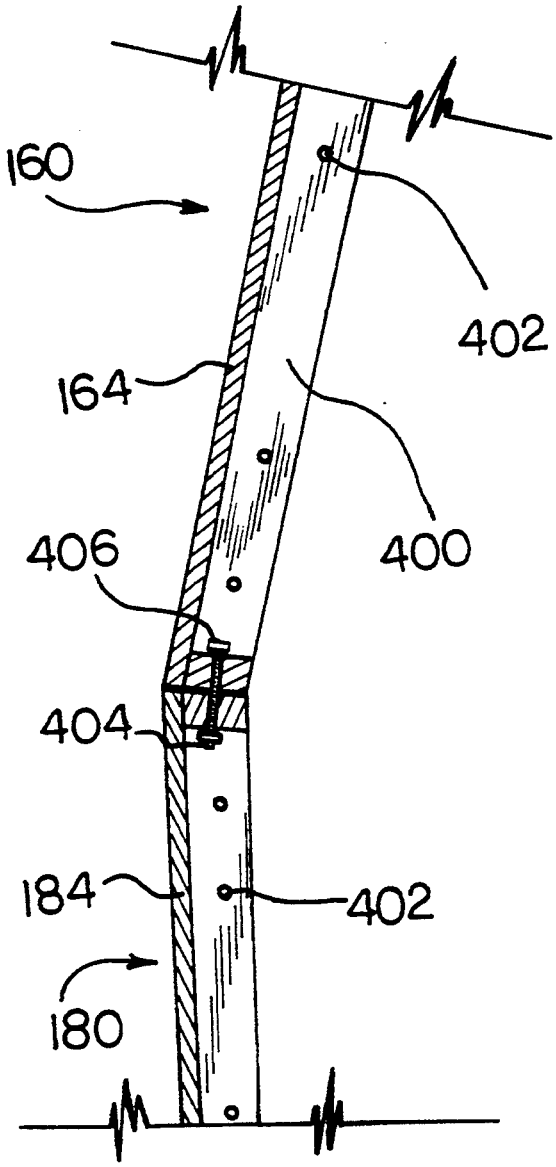
FIG. 5 is a sectional view along line 5—5 of FIG. 2.

FIG. 5 illustrates an example of the connection between panels. In the example, superposed panels in levels 160 and 180 are connected. Each panel within a respective level will include frame members 400 projecting inwardly of the structure and provided on all sides of each panel adjacent the side edges. The frame members may be nailed, glued, welded, etc. to the panels depending on the material of the panel.

Each frame member includes a plurality of spaced apart apertures 402 extending through the frame members 400. The apertures vertically and laterally adjacent panels register in alignment. The adjacent panels may then be bolted together using bolts and nuts as indicated by numerals 404 and 406.

It will be clear that all panels may be connected in a similar manner.

In an alternate embodiment, one or more upper levels of the structure illustrated may be removed and the structures either left as an open top type building or they may include alternative means for covering the top, e.g. a removable cap.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A building structure comprising:

a plurality of first panels, of second panels and of third panels, said first panels comprising rectangular panels, said second panels and said third panels having a different geometry from one another and from said rectangular panels;

at least one upper horizontal level of a common panel geometry other than said rectangular panels:

at least two further horizontal levels each comprising an alternating arrangement of two panel types of said first panels, second panels and third panels, said second panels and said third panels having at least three sides, said panels including connecting means for connection with an adjacent panel.

2. The building structure as defined in claim 1, wherein each said panel is flat.

3. The building structure as defined in claim 1, wherein said second and third panels comprise triangles and trapezoids.

4. The building structure as defined in claim 1, wherein said upper level comprises a plurality of triangular panels connected together.

5. The building structure as defined in claim 4, wherein said triangular panels are isosceles triangles.

6. The building structure as defined in claim 4, wherein said upper level includes a plurality of trapezoids connected together and beneath said triangular panels.

7. The building structure as defined in claim 1, wherein the width of said rectangular panels is constant from said upper horizontal level to each subsequent level thereafter.

8. The building structure as defined in claim 1, wherein said building structure has a surface area, about 50% of said surface area comprising rectangular panels.

9. The building structure as defined in claim 1, wherein each said level of said further levels includes a predetermined quantity of said rectangular panels, an even quantity of said rectangular panels within a horizontal level having a different width relative to said remaining rectangular panels in the same level, said different width being uniform for panels having said different width and said panels having said different width being in opposed relation within said horizontal level.

10. The building structure as defined in claim 1, wherein said building is an elliptical building.

11. The building structure as defined in claim 1, wherein said building has an open top.

12. The building structure as defined in claim 1, wherein said building has a closed top.

13. A dome building structure comprising:

a plurality of first panels, of second panels and of third panels, said first panels comprising rectangular panels, said second panels and said third panels having a different geometry from one another and from said rectangular panels;

at least one upper horizontal level having a common panel geometry other than said rectangular panels and connected together in a predetermined quantity;

at least two further horizontal levels each comprising an alternating arrangement of two panel types of said first panels, second panels and third panels, said two panel types of each of said further levels each being in said predetermined quantity, each of said panels having means for connection with an adjacent panel. pane 1.

14. The building structure as defined in claim 13, wherein each said panel is flat.

15. The building structure as defined in claim 13, wherein said panels comprise triangles, rectangles and trapezoids.

16. The building structure as defined in claim 15, wherein the width of said rectangular panels is constant from said upper horizontal level to each subsequent level thereafter.

17. The building structure as defined in claim 13, wherein each said level of said further levels includes a predetermined quantity of said rectangular panels, an even quantity of said rectangular panels within a horizontal level having a different width relative to said remaining rectangular panels in the same level, said different width being uniform for panels having said different width and said panels having said different width being in opposed relation within said horizontal level.

18. The building structure as defined in claim 13, wherein said building is an elliptical building.

19. The building structure as defined in claim 13, wherein said building has an open top.

20. The building structure as defined in claim 13, wherein said building has a closed top.

21. A method of assembling a dome structure, comprising the steps of:

providing a plurality of panels of a first type, of a second type and of a third type, said panels having at least three sides, said first type comprising rectangular panels, said second type and said third type having a different geometry from one another and from said rectangular panels;

connecting a plurality of panels having a common geometry together to format least one upper horizontal level, said panels selected from said second type and said third type;

selecting a plurality of two panel types having uncommon panel geometry; and connecting a plurality of two panel types having a different panel geometry selected from said first panels, second panels and third panels together in an alternating relationship to form at least two further horizontal levels, each horizontal level comprising an alternating arrangement of two panel types of said first panels, second panels and third panels, said two panel types of each of said further levels each being in said predetermined quantity, each of said panels having means for connection with an adjacent panel.

22. A building structure comprising a plurality of first panels, of second panels and of third panels, each of said panels having a different geometry from one another and having at least three sides, said panels being arranged in a plurality of superposed horizontal levels, each said horizontal level comprising an alternating arrangement of two panel types of said first panels, second panels and third panels, said panels including connecting means for connection with an adjacent panel.

23. The building structure as defined in claim 22, wherein said building is an elliptical building.

24. The building structure as defined in claim 22, wherein each said panel is flat.

25. A building structure having a surface area comprising:

a plurality of first panels, of second panels and of third panels, said first panels comprising rectangular panels, said second panels and said third panels having a different geometry from one another and from said rectangular panels;

at least one upper horizontal level of a common panel geometry other than said rectangular panels;

at least two further horizontal levels each comprising an alternating arrangement of two panel types of said first panels, second panels and third panels, said two panel types of each of said further levels each being in said predetermined quantity, each of said panels having means for connection with an adjacent panel.

* * * * *